United States Patent [19]

Kondo et al.

[11] Patent Number: 4,646,650

[45] Date of Patent: Mar. 3, 1987

[54] TROLLEY DEVICE IN A DUPLEX CHAIN CONVEYOR

[75] Inventors: Hirokazu Kondo; Shigekatsu Takino, both of Tokorozawa, Japan

[73] Assignee: Tsubakimoto Chain Co., Osaka, Japan

[21] Appl. No.: 605,010

[22] Filed: Apr. 27, 1984

Related U.S. Application Data

[63] Continuation-in-part of Ser. No. 348,672, Feb. 16, 1982, abandoned.

[30] Foreign Application Priority Data

Mar. 18, 1981 [JP] Japan ..... 56-36730[U]

[51] Int. Cl.[4] ..... B61B 10/02

[52] U.S. Cl. ..... 104/172.3; 104/172.4

[58] Field of Search ..... 104/170, 172 B, 172 S

[56] References Cited

U.S. PATENT DOCUMENTS

| | | | |
|---|---|---|---|
| 3,314,378 | 4/1967 | Potter et al. | 104/172 S X |
| 3,518,946 | 7/1970 | Kavieff | 104/172 B |
| 3,774,546 | 11/1973 | Krammer | 104/172 S |
| 3,800,709 | 4/1974 | DeGood et al. | 104/172 S |
| 3,818,840 | 6/1974 | Deane | 104/172 S |
| 3,874,304 | 4/1975 | Robert | 104/172 S |
| 3,986,458 | 10/1976 | Kling | 104/172 S |
| 4,389,944 | 6/1983 | Linton et al. | 104/172 S |
| 4,408,540 | 10/1983 | Dehne | 104/172 B |

FOREIGN PATENT DOCUMENTS

| | | | |
|---|---|---|---|
| 38391 | 9/1972 | Japan | 104/172 B |
| 15272 | 5/1978 | Japan | 104/172 B |
| 40145 | 3/1980 | Japan | 104/172 B |
| 267039 | 4/1970 | U.S.S.R. | 104/172 S |
| 468845 | 7/1975 | U.S.S.R. | 104/172 S |
| 574368 | 9/1977 | U.S.S.R. | 104/172 S |

*Primary Examiner*—Randolph A. Reese

*Attorney, Agent, or Firm*—Dann, Dorfman, Herrell & Skillman

[57] ABSTRACT

A duplex chain conveyor system for conveying articles along a conveyance path is provided. The duplex chain conveyor system includes a trolley device which is detachably engageable with a driven engagement member attached to a driving chain which moves within a power rail. When the trolley device is coupled with the driven engagement member, the trolley device is pulled forward on the free rail disposed along a predetermined conveyance path. An article carrier, such as a truck or hanger, is connected to the trolley device for the conveyance of articles along the conveyance path.

15 Claims, 3 Drawing Figures

TROLLEY DEVICE IN A DUPLEX CHAIN CONVEYOR

RELATED APPLICATION

This application is a continuation-in-part of U.S. application Ser. No. 348,672 filed Feb. 16, 1982, now abandoned.

FIELD OF THE INVENTION

This invention relates to a trolley device in a duplex chain conveyor, which trolley device is in detachable engagement with a pusher attached to a driving chain which moves within a power rail whereby the trolley device is pulled forward within a free rail disposed along a predetermined conveyance path. An article carrier comprising a truck or a hanger is connected to the trolley device for the conveyance of articles. In particular, this invention is concerned with an improved device for the truck conveyor or the overhead conveyor.

BACKGROUND OF THE INVENTION

Duplex chain conveyors are classified either as a so-called truck conveyor wherein the article carrier is a truck which moves on a floor and has trolley devices thereon, and a free rail for guiding the movement of a trolley device is laid in the floor, or as a so-called overhead conveyor wherein a trolley device moves within an overhead free rail and from the trolley device there depends a hanger as the article carrier.

Heretofore, there have been a duplex chain conveyors of the type disclosed in Japanese patent Publication No. 38391/1972 wherein a pusher dog and a retainer which are brought into engagement and disengagement with respect to a pusher are pivoted for rise and fall motion to a trolley device, and a duplex chain conveyor of the type disclosed in Japanese patent Publication No. 15272/1978 wherein a pusher and a retainer are pivoted for rise and fall motion to a driving chain. In both types, however, the pusher or the pusher dog and the retainer are pivotally supported separately from each other. Particularly, the pusher and the retainer shown in the latter patent publication are provided with an interlocking mechanism using links whereby both can rise or fall simultaneously, and the provision of such an interlocking mechanism results in a more complicated structure of the entire device. Besides, since the engaging/disengaging mechanism for the pusher or the pusher dog and the hook is positioned between a power rail and a free rail, it is impossible to perform the engaging and disengaging operation from outside the power rail or free rail, and it is difficult to confirm the state of engagement or disengagement.

SUMMARY OF THE INVENTION

A trolley device in a duplex chain conveyor comprises trolley means including a leading trolley connected at the front of an article carrier and a rear trolley connected at the rear of said article carrier, said leading trolley and said rear trolley being movable within a free guide rail disposed along a conveyance path, said leading trolley having coupling means including a hook lever and a cam follower lever both pivotally attached to said leading trolley and connected to each other through a connecting rod, said hook lever having an integral hook means adapted to engage a pusher or hook engagement means P of suitable drive means. The preferred drive means includes a driving chain which moves within a power rail and carries said pusher means. The hook lever also includes integral retainer means for preventing runaway of said article carrier when the coupling means is engaged with the pusher means, both said hook and said retainer means being formed integrally with said hook lever. The cam-follower lever is provided at a front end of the leading trolley with a projecting cam portion. The rear trolley has a cam rod cooperable with the coupling means of the next leading trolley, said cam rod being adapted to abut said cam portion of said cam follower lever and move it in the direction of disengagement from said pusher.

This invention, which eliminates the above-mentioned drawbacks associated with the prior art, will be described hereinafter with reference to the accompanying drawings.

BRIEF DESCRIPTION OF THE DRAWING

The accompanying drawings illustrate embodiments of this invention, in which.

DETAILED DESCRIPTION OF THE INVENTION

Figure 1:
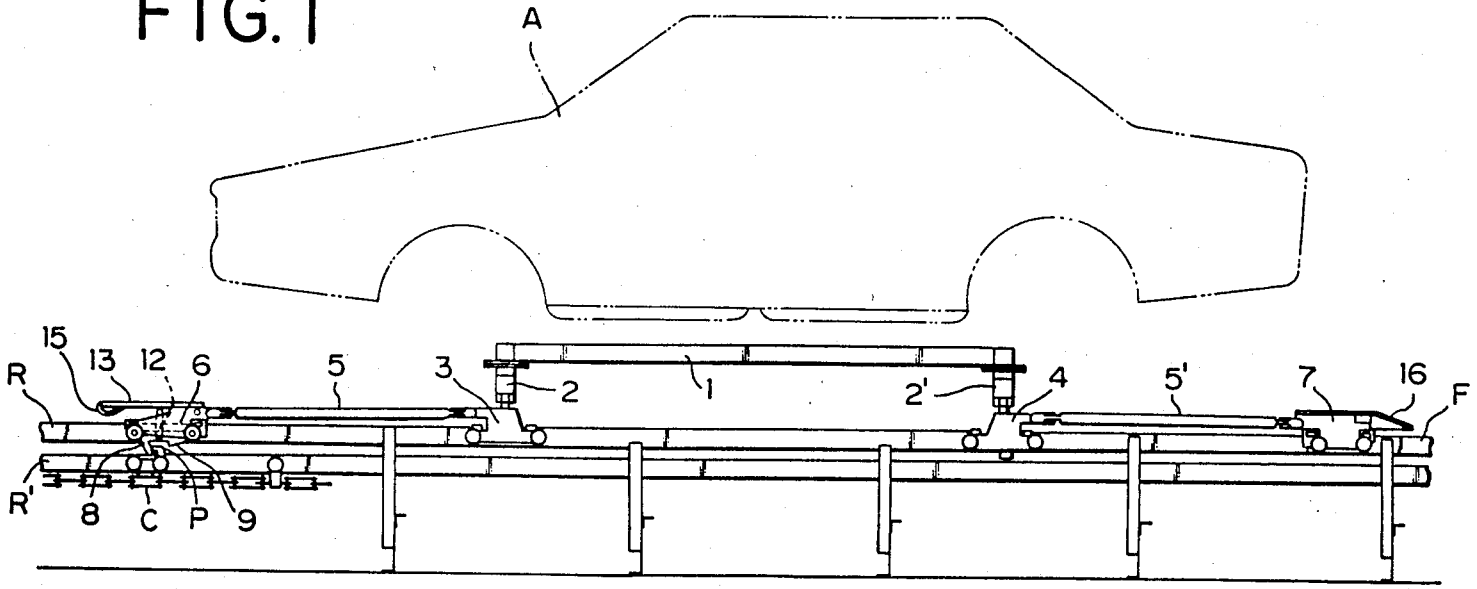
FIG. 1 is a front view of the principal part of a truck conveyor embodying the invention.

Referring first to FIG. 1, there is shown a truck conveyor, wherein a truck 1, serving as an article carrier, carries thereon an article A to be conveyed, such as a vehicular body, and at the corner portions thereof has swivel wheels (not shown) for travelling on a working floor F. At the front and rear of the truck 1, there are dependent engaging members 2 and 2', the lower ends of which are detachably connected to a front trolley 3 and a rear trolley 4, respectively. In advance of the front trolley 3, there is connected a leading trolley 6 through a connecting bar 5, while behind the rear trolley 4 there is connected a rearmost trolley 7 through a connecting bar 5', and these trolleys 3, 4, 6 and 7 serve as trolley means and move along a free rail R serving as a guide track for defining the path of travel of the trolleys.

Figure 2:
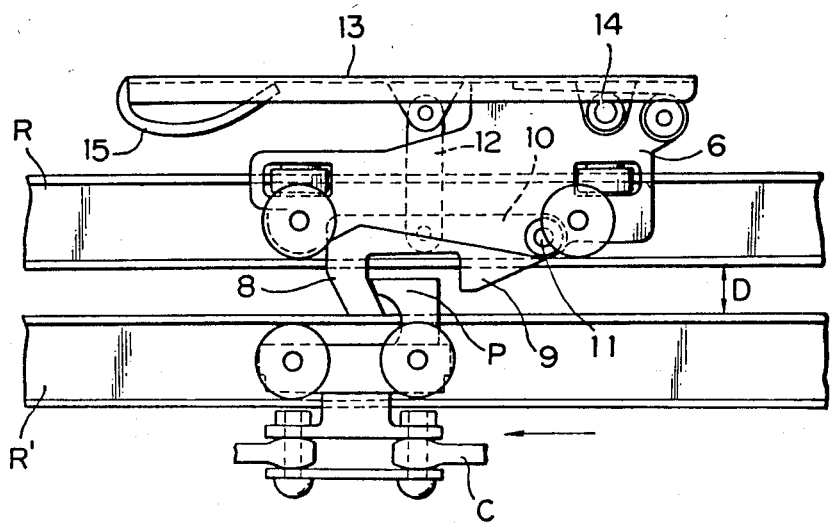
FIG. 2 is an enlarged front view of a leading trolley of FIG. 1.

As shown in FIG. 2, a hook lever 10 having integrally formed hook means 8 and retainer means 9, is mounted on the leading trolley 6 pivotably through a pin 11 and it is connected to a cam follower lever or cam lever 13 through a connecting rod 12. The cam lever 13 at one end is pivotally mounted to the leading trolley through a pin 14, and at the other end thereof, it forms a cam portion 15.

To drive the leading trolley 6, the drive means comprises a driven pusher or hook-engagement means P which engages the hook 8 of the hook lever 10, the pusher P being fixed to and carried by a driving chain C and moving within a power rail R' which directs the pusher P along the guide rail R in the direction of conveyance. To assure truck conveyance, the spacing D between the free rail R and the power rail R' is sufficiently narrow to position the hook 8 and the retainer 9 so that they are engageable with the front and back of the pusher P, respectively. During truck conveyance, the hook 8 engages the front surface of the pusher P, and if the hook 8 advances more quickly than the pusher P and disengages from the front surface of the pusher P, the retainer engages the trailing surface or back of the pusher P. Therefore, at the time of conveyance of the truck, for example, at a falling slope, if the leading trolley 6 goes ahead of or advances at a faster rate than the pusher P, the leading trolley 6 is prevented from running away because the retainer 9 comes into abutment with the back of the pusher P. As shown the projection of the retainer 9 from the rail R is less than the projection of the hook 8 so that the pusher P approaches the hook lever 10 from the rear, it may pass over the retainer 9 at a level which still assures engagement with the hook 8.

During truck storage, the spacing D (see FIG. 2) is expanded to position the pusher at the level in which the retainer 9 will not engage the pusher P. At the time of storage of the truck, a cam rod 16 projecting from the rearmost trolley of a preceding truck on said free guide rail serves as cam means to abut and push up the cam portion 15 of the lever 13, thereby pulling up the hook 8 to disengage the hook 8 from the pusher P, thus allowing the leading trolley 6 of the succeeding or following truck to stop without stopping the movement of the driving chain C. As described below, the hook 8 is pivoted upwardly without causing or requiring relative longitudinal displacement between the trolley 6 and the pusher P. The truck can then be stored. Furthermore, since the foregoing spacing D is expanded during truck storage, as previously noted, when the hook 8 has been pulled up to its disengaging position, there is no fear of abutment of the retainer 9 with a succeeding or following pusher P. Furthermore, the cam means can be provided at selected positions along said free rail since the cam means is provided on the rearmost trolley 7.

Figure 3:
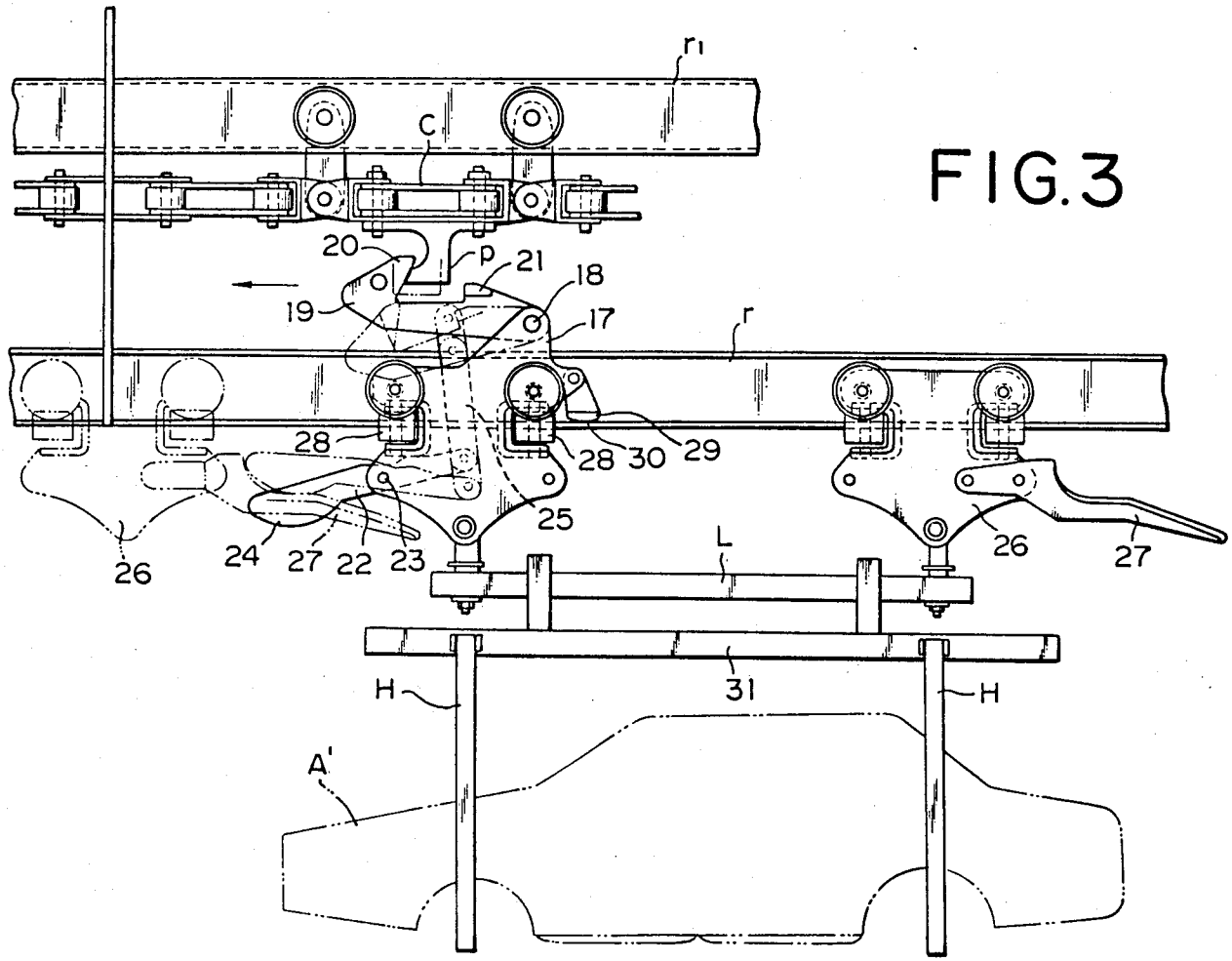
FIG. 3 is a front view of the principal part of an overhead conveyor in accordance with another embodiment of the present invention.

This invention will be further described hereinafter with respect to a leading trolley in an overhead conveyor as shown in FIG. 3. The drive means for the trolley comprises a pusher p attached to a driving chain C which is guided by roller guides on a power rail r' for propulsion of the pusher along the power rail in the direction of conveyance. The pusher p is engaged with a hook 20 and thereby pushes forward a leading trolley 17, the hook 20 being formed integrally with a hook lever 19 which is attached to the leading trolley 17 pivotally through a pin 18. Also formed integrally with the hook lever 19 is a retainer 21 for preventing the leading trolley from running away in a conveyance path having a falling gradient. As shown in FIG. 3, the height of projection of the retainer 21 from the guide rail is less than the height of projection of the hook 20, so that the pusher p may ride over the retainer 21 and engage the hook from behind when it is at a level to pass over said retainer means, without the noise and clatter which is common with separately-pivoted retainers.

A cam-follower lever is pivotally attached to the leading trolley 17 through a pin 23, and at a projecting front end thereof there is formed a cam portion 24, while the rear end thereof is connected to the hook lever 19 through a connecting rod 25. The cam portion 24 of the lever 22 may be pushed up as shown in broken lines by means of a cam rod or camming actuator means 27 which projects backward from a rearmost trolley 26 attached to the preceding hanger, and the hook lever 19 pivotally moves downward to the position indicated in broken lines whereby the hook 20 is disengaged from the pusher p. Disengagement occurs without causing or requiring relative displacement between the trolley 17 and the pusher p, longitudinally of the rails r and r' as described below.

The reference numeral 28 designates a roller which abuts against the lower edges of the free rail r to prevent each trolley from rolling off the rail, and numeral 29 designates a detent piece which pivotally depends from the leading trolley, the detent piece 29 having a lower cam surface 30 whose distance from the pivot point gradually increases toward the rear. The cam surface 30 is in contact with the inner surface of the free rail, and reverse movement of the trolley is prevented by the resulting wedge action. The spacing between the free rail r and the power rail r' and the relationship between the hook and the retainer are the same as in the foregoing truck conveyor.

The reference character L designates a load bar which is suspended between the leading trolley 17 and the rearmost trolley 26. Further suspended from the load bar L is a hanger 31 from which there hang down plural pairs of hooks H which may open and close in opposed manner for holding an article A' to be conveyed.

In this embodiment of the invention, as set forth hereinbefore, since the hook 20 and the retainer 21 which may be coupled into engagement with the pusher p, are formed as integral parts of the hook lever 19, the engaging and disengaging operation with respect to the pusher is sure and exact, and the structure is very simple as compared with the conventional structure wherein the hook and the retainer are capable of coming down on opposite sides and are biased upwardly. Furthermore, the engaging and disengaging operation for the hook lever can be performed through a connecting rod with a cam lever 22 positioned outside the free rail where it is readily visible for observation, so this operation is performed easily and even manually without fear of erroneous operation.

As is clear from both FIGS. 2 and 3, the pivotal mounting of the lever 10 on the pin 11, and the hook lever 19 on the pin 18 enables displacement of the hook lever without relative longitudinal displacement between the trolley hook means and the hook-engagement means or pusher. This is achieved because the engagement surface of the hook means is disposed substantially tangential to an imaginary circle which is centered on the pivotal axis of its respective pin and circumscribes the hook engagement means or pusher. Since the pin is spaced from the power rail beyond the hook-engagement means in each case, the hook is pivoted forwardly in the direction of conveyance relative to the pusher upon its displacement from its operative position to its inoperative position and disengages the pusher without causing or requiring relative longitudinal displacement between the trolley and the pusher.

In the truck conveyor, moreover, if the cam lever 13 for the aforesaid engaging and disengaging operation is made larger in width, it can also serve as a cover for preventing dust and other foreign matter from getting into the free rail. Additionally, since the length of this lever can be taken sufficiently large, the engaging and disengaging operation between the hook and the pusher becomes smooth. Since the hook and the retainer are formed integrally and non-pivotally with respect to the hook lever, noise is eliminated at the time of engaging and disengaging operation. Thus, the present invention is of great utilitarian value.

We claim:

1. An apparatus for conveying articles in one direction along a working floor in a predetermined path comprising:

(a) a guide rail underlying the path on said floor;

(b) a series of article carriers;

(c) at least a first and a second trolley means for each carrier engaging and movable along said guide rail, each said article carrier mounted on and spanning between said first and second trolley means at their upper sides and having means for receiving an article for conveyance along said path;

(d) drive means extending along said guide rail for conveying said trolley means along said guide rail in said one direction of conveyance, said drive means having hook-engagement means driven along the underside of said guide rail; and (e) coupling means for engaging and disengaging said trolley means and said drive means, said coupling means comprising a hook lever pivoted at one end to the first of said trolley means, said hook lever projecting beyond said underside of the guide rail and having integral hook means adjacent the opposite end and integral retainer means intermediate said ends, said hook and retainer means forming between them a downwardly-facing recess for receiving the hook-engagement means, with the hook means at the leading end of the recess and the retainer means at the trailing end of the recess, said hook lever having a pivotal axis affording displacement between a lower operative position wherein said hook means and said retainer means are engageable with said hook-engagement means to enable conveyance of said trolley means in said one direction of conveyance along said guide rail by said drive means and a raised inoperative position wherein said hook means and said retainer means are out of engagement with said hook-engagement means to prevent conveyance of said trolley means by said drive means, said pivoted end of the hook lever trailing said hook means, said hook means having an engagement surface confronting said recess and thereby said hook-engagement means in the lower operative position, said engagement surface being disposed substantially tangential to an imaginary circle which is centered on the pivotal axis of said hook lever and circumscribes said hook-engagement means when the latter is in engagement with said surface, said engagement surface being positioned so that displacement of said hook lever between operative and inoperative positions is effected without causing relative displacement between said hook means and said hook-engagement means longitudinally of said guide rail, in said operative position of said hook lever, the projection of the retainer means below said underside of the guide rail being less than the projection of the hook means to afford engagement of the hook by said hook-engagement means when it is at a level to pass under said retainer means, and a cam follower carried by the first of said trolley means projecting above the upper side of the guide rail and above said working floor in a position where it may be actuated manually, and having a connecting means extending down across said rail to the said hook lever below the underside of the guide rail to displace said hook lever below the said operative and inoperative position; and (f) cam means carried by the second trolley means and disposed adjacent said upper side of said guide rail in a position for engaging and actuating the cam follower of the first trolley means associated with the subsequent article carrier in said series.

2. An article conveyor apparatus in accordance with claim 1 wherein said drive means comprises:

(a) a power rail spaced parallel below said guide rail; and (b) a drive chain mounted on said power rail, said drive chain carrying said hook engagement means to drive said hook engagement means and thereby said trolley means in said direction of conveyance;

(c) said hook-engagement means having roller means directing said drive chain for movement along said power rail.

3. An article conveyor according to claim 2 wherein said pivotal axis of said hook lever is spaced above said power rail above said hook engagement means, whereby upon displacement from operative to inoperative positions the hook is pivoted upwardly and forwardly in the direction of conveyance relative said hook engagement means.

4. An article conveyor apparatus in accordance with claim 2 wherein the power rail is spaced below said guide rail at a given distance along a predetermined path of conveyance and is spaced below said guide rail at a greater distance along a predetermined storage path, and said hook-engagement means is adapted to disengage said trolley means from said drive means independently of said coupling means for storage when the spacing of said power rail from said guide rail is expanded to said greater distance.

5. An article conveyor apparatus in accordance with claim 1 wherein said first trolley means of said subsequent carrier trails said second trolley means on said guide rail and wherein said cam means is provided on a trailing end of said second trolley means, and said cam follower is provided on a leading end of said first trolley means of said adjacent carrier such that said cam means on said second trolley means of one carrier is engageable with said cam follower of said first trolley means of the subsequent carrier.

6. An apparatus for conveying articles in one direction along a predetermined overhead path comprising:

(a) a guide rail defining said overhead path;

(b) a series of article carriers;

(c) at least a first and a second trolley means for each carrier engaging and movable along said guide rail, each said article carrier mounted on and spanning between said first and second trolley means at their lower sides and having means for receiving and suspending an article for conveyance along said path;

(d) drive means extending along said guide rail for conveying said trolley means along said guide rail in said one direction of conveyance, said drive means having hook-engagement means driven along the upperside of said guide rail; and (e) coupling means for engaging and disengaging said trolley means and said drive means, said coupling means comprising a hook lever pivoted at one end to the first of said trolley means, said hook lever projecting beyond said upperside of the guide rail and having integral hook means adjacent the opposite end and integral retainer means intermediate said ends, said hook and retainer means forming between them an upwardly-facing recess for receiving the hook-engagement means, with the hook means at the leading end of the recess and the retainer means at the trailing end of the recess, said hook lever having a pivotal axis affording displacement between a raised operative position wherein said hook means and said retainer means are engageable with said hook-engagement means to enable conveyance of said trolley means in said one direction of conveyance along said guide rail by said drive means and a lower inoperative position wherein said hook means and said retainer means are out of engagement with said hook-engagment means to prevent conveyance of said trolley means by said drive means, said pivoted end of the hook lever trailing said hook means, said hook means having an engagement surface confronting said recess and thereby said hook-engagement means in the raised operative position, said engagement surface being disposed substantially tangential to an imaginary circle which is centered on the pivotal axis of said hook lever and circumscribes said hook-engagement means when the latter is in engagement with said surface, said engagement surface being positioned so that displacement of said hook lever between operative and inoperative positions is effected without causing relative displacement between said hook means and said hook-engagement means longitudinally of said guide rail, in said operative position of said hook lever, the projection of the retainer means above said upperside of the guide rail being less than the projection of the hook means to afford engagement of the hook by said hook-engagement means when it is at a level to pass over said retainer means, and a cam follower carried by the first of said trolley means projecting below the under side of the guide rail into said overhead path, and having a connecting means extending upwardly across said rail to the said hook lever above the upperside of the guide rail to displace said hook lever between said operative and inoperative position; and (f) cam means carried by the second trolley means and disposed adjacent the lower side of said guide rail in a position for engaging and actuating the cam follower of the first trolley means associated with the subsequent article carrier in said series.

7. An article conveyor apparatus in accordance with claim 6 wherein said drive means comprises:

(a) a power rail spaced parallel above said guide rail; and (b) a drive cahin mounted on said power rail, said drive chain carrying said hook engagement means to drive said hook engagement means and thereby said trolley means in said direction of conveyance;

(c) said hook-engagement means having roller means directing said drive chain for movement along said power rail.

8. An article conveyor according to claim 7 wherein said pivotal axis of said hook lever is spaced below said power rail below said hook engagement means, whereby upon displacement from operative to inoperative positions the hook is pivoted downwardly and forwardly in the direction of conveyance relative said hook engagement means.

9. An article conveyor apparatus in accordance with claim 7 wherein the power rail is spaced above said guide rail at a given distance along a predetermined path of conveyance and is spaced above said guide rail at a greater distance along a predetermined storage path, and said hook-engagement means is adapted to disengage said trolley means from said drive means independently of said coupling means for storage when the spacing of said power rail from said guide rail is expanded to said greater distance.

10. An article conveyor apparatus in accordance with claim 6 comprising brake means carried by said trolley means and engaging said guide rail to prevent movement of said trolley means in a reverse direction relative to said direction of conveyance.

11. An article conveyor apparatus in accordance with claim 10, wherein said brake means comprises a brake lever and means mounting said brake lever for wedging between said trolley means and said guide rail upon reverse movement of said trolley means to prevent reverse movement thereof.

12. An article conveyor apparatus in accordance with claim 6 wherein said hook means is engageable with a leading end of said hook engagement means to enable conveyance of said trolley means along said guide rail and said retainer means is engageable with a trailing end of said hook engagement means to prevent movement of said trolley means along said guide rail at a rate faster than said hook engagement means.

13. An article conveyor apparatus in accordance with claim 6 wherein said cam follower is mounted for pivotal displacement relative to said trolley said connecting means comprising a rod connecting said cam follower with said hook lever to translate said displacement of said cam follower into pivotal displacement of said hook lever between said operative and inoperative positions.

14. An article conveyor apparatus in accordance with claim 13 wherein said connecting means comprises a connecting rod pivotally mounted between said hook lever and said cam follower.

15. An article conveyor apparatus in accordance with claim 6 wherein said first trolley means of said adjacent carrier trails said second trolley means on said guide rail and wherein said cam means is provided on a trailing end of said second trolley means, and said cam follower is provided on a leading end of said first trolley means of said adjacent carrier such that said cam means on said second trolley means is engageable with said cam follower of said first trolley means.

* * * * *